US005387141A

United States Patent [19]

Toyohara et al.

[11] Patent Number: 5,387,141

[45] Date of Patent: Feb. 7, 1995

[54] NAVIGATION STABILIZING SYSTEM FOR WATER JET PROPULSION VESSEL

[75] Inventors: Makoto Toyohara; Kiyonobu Kobayashi, both of Hamamatsu, Japan

[73] Assignee: Sanshin Kogyo Kabushiki Kaisha, Hamamatsu, Japan

[21] Appl. No.: 853,502

[22] Filed: Mar. 18, 1992

[30] Foreign Application Priority Data

Mar. 19, 1991 [JP] Japan ..... 3-081447

[51] Int. Cl.[6] ..... B63H 11/08; B63H 11/107

[52] U.S. Cl. ..... 440/41; 440/40

[58] Field of Search ..... 440/38, 40–43, 440/46, 52; 114/162

[56] References Cited

U.S. PATENT DOCUMENTS

| | | | |
|---|---|---|---|
| 3,336,752 | 8/1967 | Smith | 440/41 |
| 3,422,788 | 1/1969 | Horan, Jr. | 440/41 |
| 3,478,712 | 11/1969 | Fox | 440/41 |
| 3,613,630 | 10/1971 | Jacuzzi | 440/41 |
| 3,906,885 | 9/1975 | Woodfill | 440/42 |
| 3,943,876 | 3/1976 | Kiekhaefer | 440/43 |
| 3,976,026 | 8/1976 | Eastling | 440/43 |
| 3,982,494 | 9/1976 | Posti | 440/43 |
| 4,807,553 | 2/1989 | Brown | 114/162 X |
| 5,080,032 | 1/1992 | Giles | 440/38 |
| 5,094,182 | 3/1992 | Simner | 440/42 |

FOREIGN PATENT DOCUMENTS

| | | | |
|---|---|---|---|
| 5628095 | 8/1954 | Japan . | |
| 283593 | 11/1990 | Japan | 440/38 |

*Primary Examiner*—Sherman Basinger

*Attorney, Agent, or Firm*—Knobbe, Martens, Olson & Bear

[57] ABSTRACT

A navigation stabilizing system for a water jet propulsion vessel which includes a water jet unit that has an impeller housing in which an impeller is positioned for drawing water through a water inlet and discharging it through a discharge port in the housing for propulsion of the water vessel. The vessel further includes a rudder which is disposed behind the water inlet port and set off center of the water inlet port and off center of the center line of the hull of the vessel.

12 Claims, 4 Drawing Sheets

NAVIGATION STABILIZING SYSTEM FOR WATER JET PROPULSION VESSEL

BACKGROUND OF THE INVENTION

This invention relates to a navigation stabilizing system for a water jet propulsion vessel, and more particularly to an improved navigation stabilizing system for such a vessel which includes a rudder assembly positioned off center from the center line of the watercraft to improve the stability of the vessel.

Water jet propulsion units are well known and widely utilized for water vessels. These units conventionally employ an impeller housing in which an impeller is contained that draws water through a water inlet and discharges it through a discharge port in the housing for propulsion of the watercraft. It has also been proposed to mount a rudder at the stern of the watercraft along the center line of the hull and water inlet port for navigation. Such a system is provided in unexamined Japanese patent publication 56-28095. Although conventional systems of this type are generally satisfactory, difficulties sometimes arise in maintaining steering stability against the water forces acting on the watercraft hull in response to water being discharged through the discharge nozzle by simply installing a rudder along the center line of the hull.

It is, therefore, a principal object of this invention to provide a navigation stabilizing system for a water jet propulsion vessel wherein good stability of the vessel is maintained during operation.

It is a further object of this invention to provide a navigation stabilizing system for a water jet propulsion vessel which includes a water jet unit having a rotating member and a rudder assembly which is positioned off center of the center line of the vessel corresponding to the rotating direction of the rotating member to provide good control during operation of the vessel.

SUMMARY OF THE INVENTION

This invention is adapted to be embodied in a navigation stabilizing system for a watercraft that is powered by a jet propulsion unit. The water jet unit comprises a housing having a water inlet port and a water discharge port and a water passage which communicates the inlet port with the discharge port. An impeller is rotatably supported within the water passage for drawing water into the inlet port and discharging water out of the discharge port, In accordance with the invention, a rudder is positioned below the housing and off-center of the center line of the watercraft to provide good stability for the watercraft.

DETAILED DESCRIPTION OF THE PREFERRED EMBODIMENTS OF THE INVENTION

Figure 1:
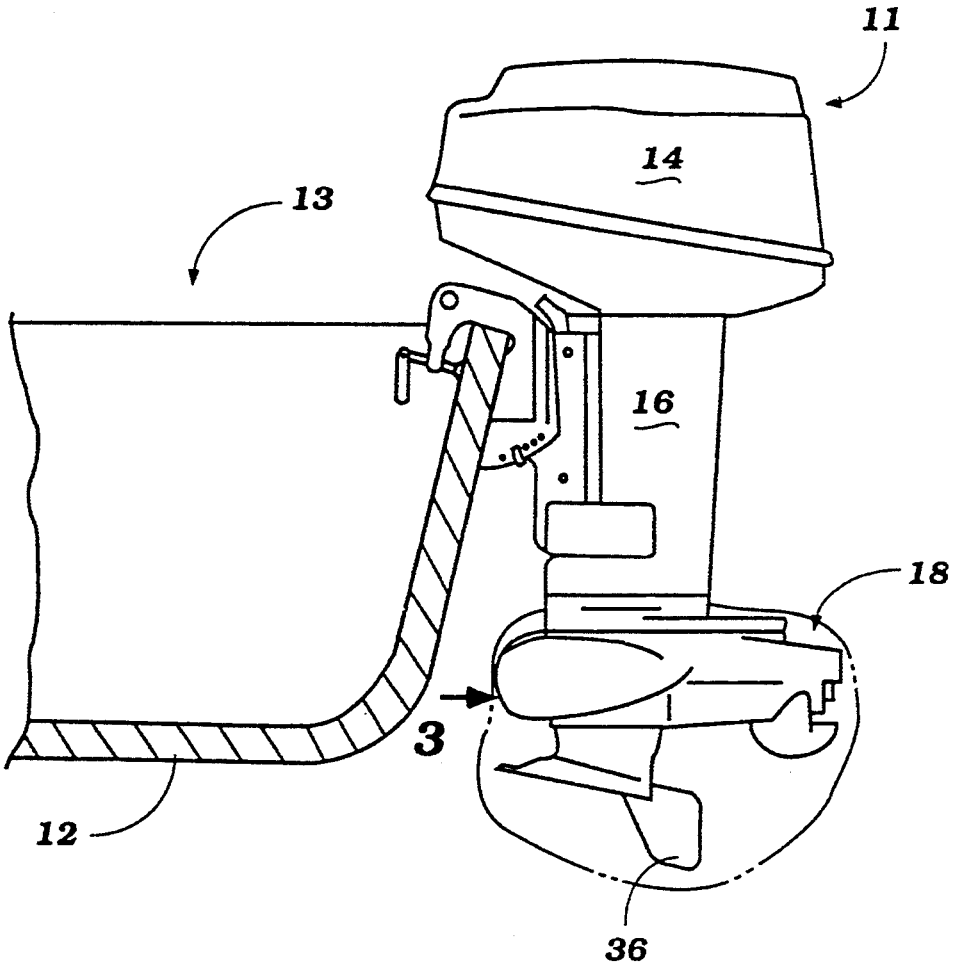
FIG. 1 is a side elevational view of an outboard jet propulsion unit attached to an associated watercraft and constructed in accordance with an embodiment of the invention.

Referring first to FIG. 1, an outboard jet propulsion unit constructed in accordance with an embodiment of the invention is identified generally by the reference numeral 11 and is shown as attached to the transom of the hull 12 of an associated watercraft 13. The outboard jet propulsion unit 11 includes a power head that contains an internal combustion engine which is surrounded by a protective cowling 14. The internal combustion engine drives an output shaft which, in turn, drives a driveshaft 15 (see FIG. 2) that is journaled for rotation within a driveshaft housing 16 that depends from the power head. This driveshaft 15 drives an impeller 17 (see FIG. 2) of a water jet unit 18 that is integrally connected to the driveshaft housing 16.

A steering shaft is affixed to the driveshaft housing 16 in a known manner and is supported for steering movement about a generally vertically extending steering axis within a swivel bracket assembly. The swivel bracket assembly is, in turn, pivotally connected to a clamp bracket by means of a tilt shaft for tilt and trim movement of the outboard jet propulsion unit 11. The clamp bracket includes means for affixing the outboard 11 to the hull 12 of the watercraft 13.

Figure 2:
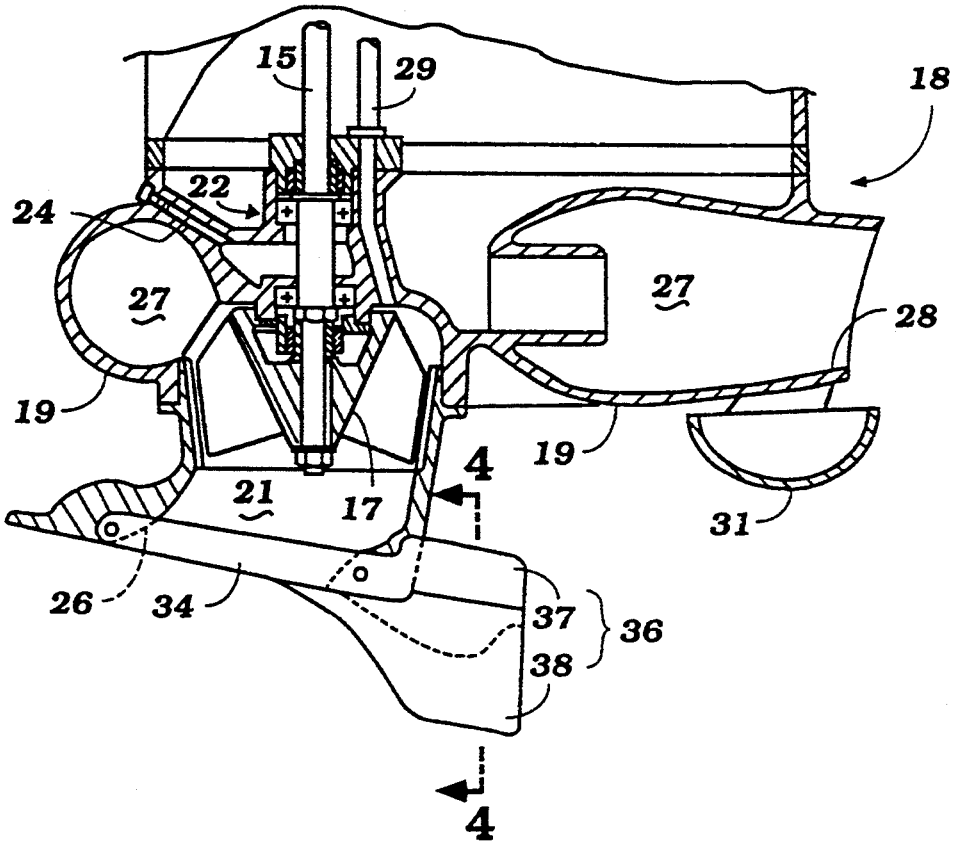
FIG. 2 is a cross sectional view of the jet propulsion unit and rudder assembly enclosed in broken lines in FIG. 1.

Referring now more specifically to FIG. 2, the water jet unit 18 is comprised of an outer housing 19 that has an impeller chamber 21 formed therein where the impeller 17 is rotatably journaled by means of a bearing structure 22. The bearing structure 22 includes an oil chamber 23 which has an oil hole 24 through which oil may be added to or drained from this chamber 23.

The impeller 17 is connected for rotation with the driveshaft 15 and draws water through a water inlet 26 formed at the lower end of the housing 19 and into the impeller chamber 21 where the water is pressurized. Most of the water that is drawn in by the impeller 17 is then discharged through a volute chamber 27 formed in the jet unit 18 and out through a discharge port 28 formed at the rear end of the housing 19. A small amount of water drawn into the impeller chamber 21 is pumped through a cooling water pipe 29 extending from the chamber 21 upward to an engine cooling jacket for cooling of the engine.

A flow deflecting reverse bucket 31 is provided in order to permit the watercraft 13 to be operated in a reverse mode. The reverse bucket 31 is kept in its downward position, as shown in FIG. 2, during normal forward operation but is adapted to be pivoted upward so that it extends across the discharge port 28 to reverse the direction of thrust, as is well known in this art. The reverse bucket 31 is connected to opposite sides of the housing 19 near the discharge port 28 by a pivot bolt assembly and is typically actuated by an operating lever assembly which includes a wire actuator extending between the bucket 31 and an operating lever positioned in the-watercraft 13 forwardly of the driver's seat and near the other controls for the watercraft 13.

Figure 3:
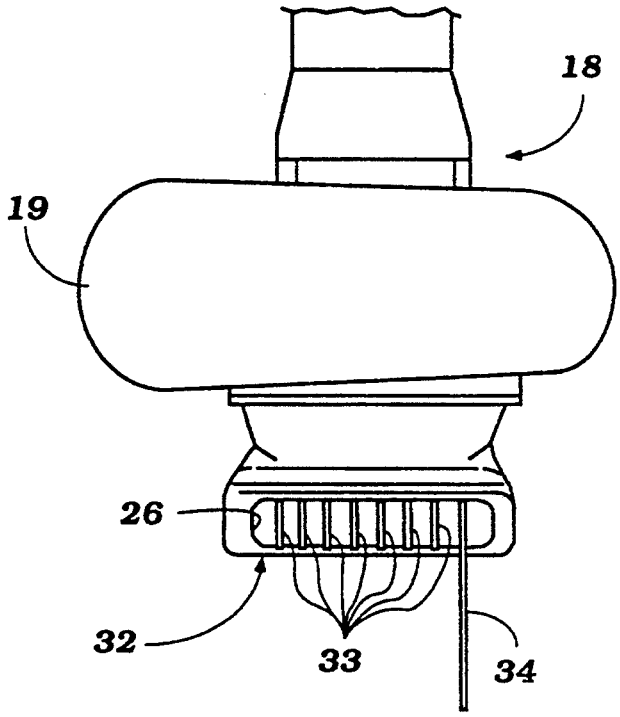
FIG. 3 is a front view of the jet propulsion unit looking in the direction of the arrow in FIG. 1 showing a positioning of the rudder grille.

Referring now to FIG. 3, in addition to FIG. 2, it will be seen that a grille, identified generally by the reference numeral 32, is positioned across the water inlet port 26 and has a plurality of generally vertically extending grille elements 33 positioned in the fore-and-aft direction of the hull 12 parallel to the center line of the watercraft 13. The grille elements 33 serve to prevent foreign objects from entering the impeller chamber 21. In accordance with the invention, one of the generally vertically extending grille elements, identified by the reference numeral 34, is positioned on the right side of the grille 32 and water inlet port 26 as seen from FIG. 3 and is affixed at both ends of the inlet port 26 to the housing 19. The grille element 34 extends downwardly from the inlet port 26 below the water jet unit 18. That is, the grille element 34 is positioned off center to the left of the center line of the hull 12 as seen from the rear of the watercraft 13 and, because of its downward extension, acts as a rudder in cooperation with a rudder assembly to be described to provide navigation stability to the watercraft 13.

Figure 4:
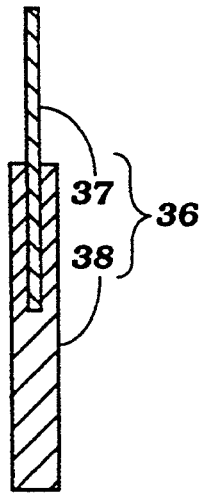
FIG. 4 is a cross sectional view of the rudder assembly taken along lines 4—4 in FIG. 2.

A rudder assembly, identified generally by the reference numeral 36, is provided to assist in the steering and stability of the watercraft 13. The rudder assembly 36 includes a base portion 37 which is integrally formed with the rear portion of the rudder grille 34 and extends rearwardly from the inlet port 26. A rudder body 38, which is preferably made of rubber, has a slot in which the lower edge of the rudder base 37 is fitted, as shown in FIG. 4, and may be rigidly affixed in that position by heat treatment and/or screws. The rudder body 38 extends downwardly below the water jet unit 18. When constructed out of rubber or other similar material, the rudder body 38 is well suited for absorbing and withstanding impacts that result when the rudder body 38 strikes an obstacle.

By setting the rudder grille 34 and rudder assembly 36 off center in the direction corresponding to the rotation of the impeller 17, the steering instability which may result from the water forces generated due to the rotation of the impeller 17 can be eliminated or greatly reduced. The positioning of the rudder grille 34 and rudder assembly 36 off center to the right as seen from the front of the jet propulsion unit 11 assumes that the impeller 17 is constructed to rotate in the clockwise direction for forward propulsion as seen from the front.

Figure 5:
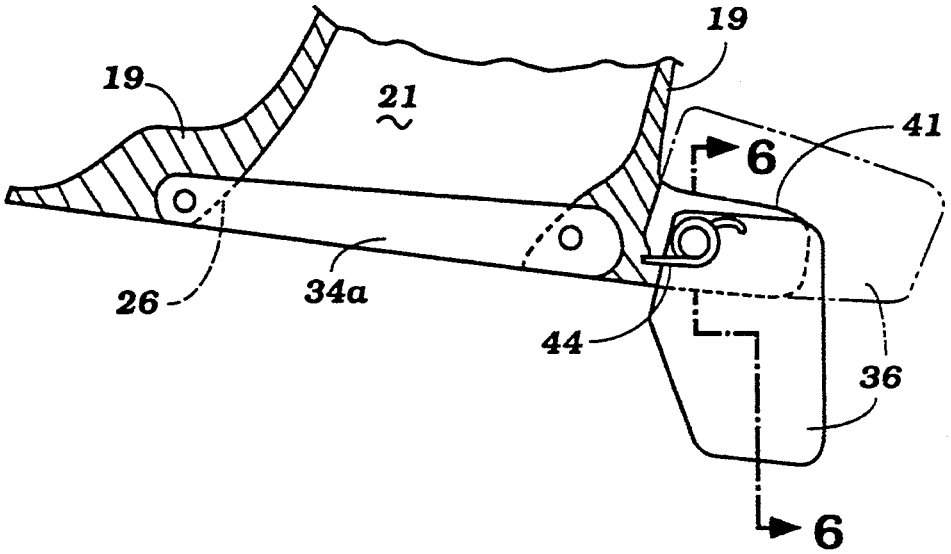
FIG. 5 is a side view showing a second embodiment of the invention, with portions shown in cross section, illustrating the main rudder assembly and rudder grille.
Figure 6:
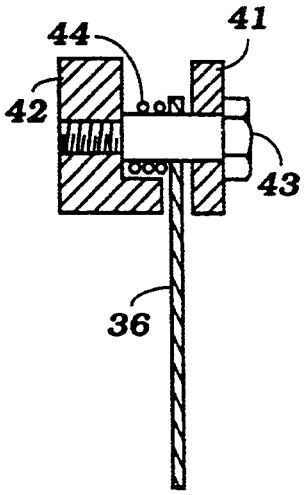
FIG. 6 is a cross sectional view of the main rudder assembly taken along line 6—6 in FIG. 5.

FIGS. 5 and 6 illustrate another embodiment of the invention. In this embodiment, the rudder grille 34a is on the left side of the grille 32 and water inlet port 26, and therefore is positioned off center to the left of the center line of the hull 12 as seen from the front of the jet propulsion unit 11. In this case, the rotation of the impeller 17 would be counterclockwise for forward propulsion as seen from the front of jet propulsion unit 11.

FIGS. 5 and 6 also illustrate a different construction and arrangement of the rudder assembly 36. Supporting piece 41 extends rearwardly from the housing 19 and is connected to a second supporting piece 42 by means of a generally horizontally extending support bolt 43. The rudder assembly 36 is pivotally supported on the bolt 43 between the supporting pieces 41 and 42. A double acting torsion spring 44 encircles the bolt 43 and is positioned between the supporting piece 42 and the rudder assembly 36 and acts to maintain the rudder assembly 36 in its downward operating position as shown in solid lines in FIG. 5 under normal conditions. The spring 44 also acts to urge the rudder assembly 36 into the tilted up position and hold it there as shown in phantom lines in FIG. 5 when a sufficient rearwardly directed force is applied to the rudder assembly 36 when it is in its downward position. Thus, in the event the rudder assembly 36 strikes an obstacle during navigation, the rudder assembly 36 is able to swing upwardly to prevent, or at least minimize, impact damage to the rudder assembly 36. To return the rudder assembly 36 to its downward position, a sufficient forwardly directed force is applied to the rear edge of the rudder assembly 36 against the force of the spring 44 until it begins to act in the other direction.

It should be readily apparent from the foregoing description that a watercraft powered by a water jet propulsion unit and having improved navigation stability has been illustrated and described. Although various embodiments of the invention have been illustrated and described, various changes and modifications may be made without departing from the spirit and scope of the invention, as defined by the appended claims.

We claim:

1. A navigation stabilizing system for a watercraft powered by a water jet unit comprising a housing having a water inlet port and a water discharge port positioned to the rear of said water inlet port and a water passage communicating the inlet port with the discharge port, an impeller rotatably supported within the water passage for drawing water in the inlet port and discharging the water out of the discharge port, at least one grille element extending across a portion of the water inlet port, and a rudder carried by said housing adjacent to one side of said water inlet port forwardly of said discharge port and extending lower than said at least one grille element and off-center and to one side only of the center line of the watercraft when the watercraft is set for straight-ahead operation.

2. A navigation stabilizing system as recited in claim 1, wherein said rudder comprises a rudder element positioned across a portion of the water inlet port to one side only of the center line when the watercraft is set for straight-ahead operation.

3. A navigation stabilizing system as recited in claim 2, wherein said rudder further comprises a rudder assembly positioned on the same side of the center line as said rudder element when the watercraft is set for straight-ahead operation and extending rearwardly from the water inlet port and downwardly below the water jet unit.

4. A navigation stabilizing system as recited in claim 3, wherein said rudder assembly is affixed to a rear portion of said rudder element.

5. A navigation stabilizing system as recited in claim 4, wherein said rudder assembly includes a base portion affixed to the rear portion of said rudder element and extending rearwardly from the discharge port.

6. A navigation stabilizing system as recited in claim 5, wherein said rudder assembly further includes a body portion affixed to the base portion and extending downwardly below the water jet unit.

7. A navigation stabilizing system as recited in claim 3, wherein said rudder assembly includes a pair of support members, and a bolt member extending through the support members for pivotally supporting said rudder assembly between the support members, said rudder assembly being movable between a downward and an upward position.

8. A navigation stabilizing system as recited in claim 7, wherein said rudder assembly further includes a spring for biasing said rudder assembly in its downward position.

9. A navigation stabilizing system as recited in claim 7, wherein said rudder assembly further includes a double acting torsion spring for biasing said rudder assembly in either its downward or upward position at any particular time.

10. A navigation stabilizing system as recited in claim 1, wherein said rudder is positioned rearwardly of said at least one grille element.

11. The navigation stabilizing system for a watercraft powered by a water jet as defined in claim 1, wherein the water jet unit comprises an outboard drive adapted to be affixed to the transom of the associated watercraft and comprised of a power head having an internal combustion engine, a lower unit and drive shaft housing depending from said power head and defining the water jet unit housing, the impeller being driven by said engine.

12. The navigation stabilizing system for a watercraft powered by a water jet as defined in claim 11, wherein the impeller is rotatable about a generally vertically extending axis.

* * * * *